United States Patent [19]

Taylor

[11] Patent Number: 4,771,206

[45] Date of Patent: Sep. 13, 1988

[54] IMPROVED JEWELRY BOX

[76] Inventor: Donna M. Taylor, 114 Twilight, Placentia, Calif. 92670

[21] Appl. No.: 874,503

[22] Filed: Jun. 16, 1986

[51] Int. Cl.[4] ..... A47B 49/00

[52] U.S. Cl. ..... 312/135; 211/70; 312/125; 312/305; 312/311

[58] Field of Search ..... 312/311, 305, 125, 227, 312/135, 238; 211/70

[56] References Cited

U.S. PATENT DOCUMENTS

| | | | |
|---|---|---|---|
| 456,728 | 7/1891 | Lamson | 211/70 X |
| 1,259,623 | 3/1918 | Herrick | 211/70 |
| 1,416,566 | 5/1922 | McCleary | 312/125 |
| 1,497,825 | 6/1924 | Zahl | 312/125 X |
| 1,613,655 | 1/1927 | Hainzigianis | 312/227 X |
| 3,472,389 | 10/1969 | Lowe | 211/70 |
| 3,880,484 | 4/1975 | Sicina | 312/125 X |
| 4,058,356 | 11/1977 | Michal | 312/305 |
| 4,124,262 | 11/1978 | Schill | 312/305 |
| 4,170,392 | 10/1979 | Sperak | 312/305 X |

*Primary Examiner*—Peter A. Aschenbrenner
*Assistant Examiner*—Thomas A. Rendos

[57] ABSTRACT

An improved jewelry box is provided for displaying and storing all types and kinds of jewelry, costume or otherwise, whereby all kinds may be kept in a single place, separated, yet compact display, and which provides for rapid, simple access to each jewelry item.

8 Claims, 2 Drawing Sheets

IMPROVED JEWELRY BOX

BACKGROUND OF THE INVENTION

1. Field of the Invention

The present invention relates to jewelry storage and display boxes, and more particularly to, jewelry storage and display boxes which include a rotatable turnstile, a lower drawer, and hooks disposed on the inside sidewalls thereof whereby all kinds and types of jewelry may be separated, displayed and stored for ready access and use.

2. Description of the Prior Art

It seems that every female, whether she be a girl or a woman, manages to somehow accumulate and collect a multitudinous array of jewelry items of every type, whether precious or costume. Such items consist of chains, hooks, pins, clamping mechanisms and may involve rather complex forms and shapes flexibly coupled and entwined together to create the desired appearance or "look". Frequently, these items are stored and kept in small boxes in the top drawer of her dresser, but, when such drawer is opened, desperation and sometimes near panic sets in, as a collision begins to unfold as the rush of time pressures meet the search for the desired bauble. Since relatively few pieces of jewelry are instantly visible and the process begins of looking in this box or that for the particular item she wants to compliment and coordinate with her attire for that particular occasion, substantial and precious time is lost, usually amid calls from her partner for the event of "hurry up or we'll be late". With this particular back drop in mind, the present invention was created.

The prior art contains a variety of jewelry display and storage boxes, some of which incorporate a turnstile element.

One such prior device is shown and illustrated in U.S. Pat. No. 259,742 which relates to a showcase for watch chains. A rectangular box, or showcase, is provided with a plurality of slidable glass panels arranged in the frame to form the sides of the showcase, one or more of which are adapted to be raised to provide an opening into the showcase in order to furnish convenient access to the interior of the showcase. Inside the showcase, vertical cylinder B is pivotally connected to the showcase via a pair of pivot bearings affixed to the top and bottom of the frame of the showcase. One or more bands C with hooks b are mounted about the cylinder B. The hooks allow the watch chains to be suspended therefrom for display and storage purposes. However, in comparison with the applicant's new and unique jewelry box, this unit fails to incorporate a slideable interior unit with a separate drawer at the bottom thereof, sidewall hooks, as well as a turnstile incorporating a plurality of arms extending therefrom as envisioned by the present invention disclosed herein.

Another jewelry and display box characteristic of the prior art is shown and illustrated in U.S. Pat. No. 631,083 which is described as a display box for silk skeins. It consists of a window box, generally rectangular in shape, and incorporates an upright post B which is coupled to a combination bevel gear and pinon arrangement disposed at the base of the window box or casing A whereby the knob and rod arrangement disposed at the base of the casing A allows the post B to be rotated by the observer viewing the displayed silk skiens. Interlocking and detachable arms E are mounted in tubular arms E which are themselves mounted to the post B. This particular invention is characteristically distinguishable from the applicant's device disclosed herein by the same comments tendered with respect to the previously discussed U.S. Pat. No. 259,742, and is further distinguished by virtue of the detachable arms E which do not employ slots, hooks, or apertures thereon or therethrough by which to simultaneously support and separate each jewelry item hung on the arm. The applicant's new and improved jewelry box incorporates these very desirable features.

Prior art U.S. Pat. No. 992,689 illustrates and teaches a display unit which is quite similar in construction and form as the device of U.S. Pat. No. 259,742, the same comments given previously apply equally with respect to this particular invention.

The invention disclosed in U.S. Pat. No. 3,880,484 s a plurality of plate-like members 7,8,9,10,11 and 12 which are shown in FIG. 4 and are mounted to the shaft 6. The members 7,8,9,10,11 and 12 have a plurality of hooks thereon by which jewelry items are hung therefrom. A single door 6 provides access into the interior of the jewelry box housing 1. However, it is quite obvious that this device suffers from the same deficiencies as previously discussed with respect to the prior art patents herein.

Perhaps the most closely related prior art U.S. Patent of which the applicant is aware is U.S. Pat. No. 4,058,356. The jewelry box 10 disclosed therein includes a rectangular box having two hinged sidewalls 12 and 14. A bottom shelf 24 provides a base for the rotatable member 26. Fingers 30 are secured to the member 26 and are used for suspending jewelry therefrom. A container 38 is provided and is disposed beneath the shelf 24 but is not slidably mounted thereto to function as a guided drawer as does the applicant's device. Hooks 36 are mounted along the insides of the sidewalls 16 and 18, and hooks 34 and 36 are for hanging jewelry items therefrom. The internal unit in this item does not slide out of the exterior unit as taught by the applicant's device and further, it does not teach the use of a plurality of turnstiles as does applicant's device. Additionally, this device employs two hinged sidewalls 12 and 14; applicant's unit economically employs only a single hinged sidewall. Applicant's device teaches the use of arms which are slotted or have apertures therethrough, or incorporates means whereby each adjacently disposed jewelry item is separated; the jewelry box of U.S. Pat. No. 4,058,356 does not teach or disclose this very important feature. Applicant's device incorporates a guided drawer disposed at the bottom of her improved jewelry box; this invention does not. Further, the shelf 24 cannot be constructed to practically allow the combined weight of the tube 26, the shelf's own weight, the weight of the arms 30, the dimes in the dime back formed by the hollow tube 26, and the various jewelry items selected to be supported thereby because the shelf 24 is only supported along two of its four sides. If it functions at all in the manner suggested, it will rapidly be destroyed through normal, regular and anticipated use.

It is for these reasons and difficulties inherently incorporated in these prior art jewelry boxes, that applicant created the present invention in order to overcome the problems presented by the prior art.

SUMMARY OF THE INVENTION AND OBJECTS

Basically, the present invention relates to an improved jewelry storage and display box. Such comprises an improved jewelry box and is provided for displaying and storing all types and kinds of jewelry, costume or otherwise, whereby all kinds may be kept in a single place, separated yet compact, and providing for rapid, simple access to each jewelry item.

One object of the instant invention is to provide a jewelry box of relatively simple structure.

Another important and primary object of the instant invention is to provide a jewelry box which incorporates the storage and display convenience and flexibility of a turnstile, a drawer, sidewalls, and a mechanism for sliding the entire structure from its position within the box to at least partially outside of the jewelry box.

A yet still further important and substantial object of the invention is to provide a jewelry box storage and display box which may be inexpensively manufactured.

It is one further primary and important object of the invention disclosed and described herein to provide an improved jewelry box design which allows for convenient and comfortable access to any one of a significant number of jewelry articles quickly and without substantial delay.

Another object of the invention is to provide an improved jewelry box for jewelry storage and display so that when the jewelry box doors are opened substantially all of the jewelry is instantly visible and readily accessible.

It is yet a still further primary object of the instant invention to provide alternatively a pair of turnstiles for rapid access to the various jewelry items hanging therefrom.

It is a further important and primary object of the invention to provide an improved jewelry storage and display box which readily and conveniently provides such for long and dangling-type earrings which fashionwise have become increasingly popular with the female gender.

The invention comprises certain characteristics and features of construction which are hereinafterwards described in greater detail, both in the Drawings and in the claims appended hereto.

DESCRIPTION OF THE PREFERRED EMBODIMENT

Figure 1:
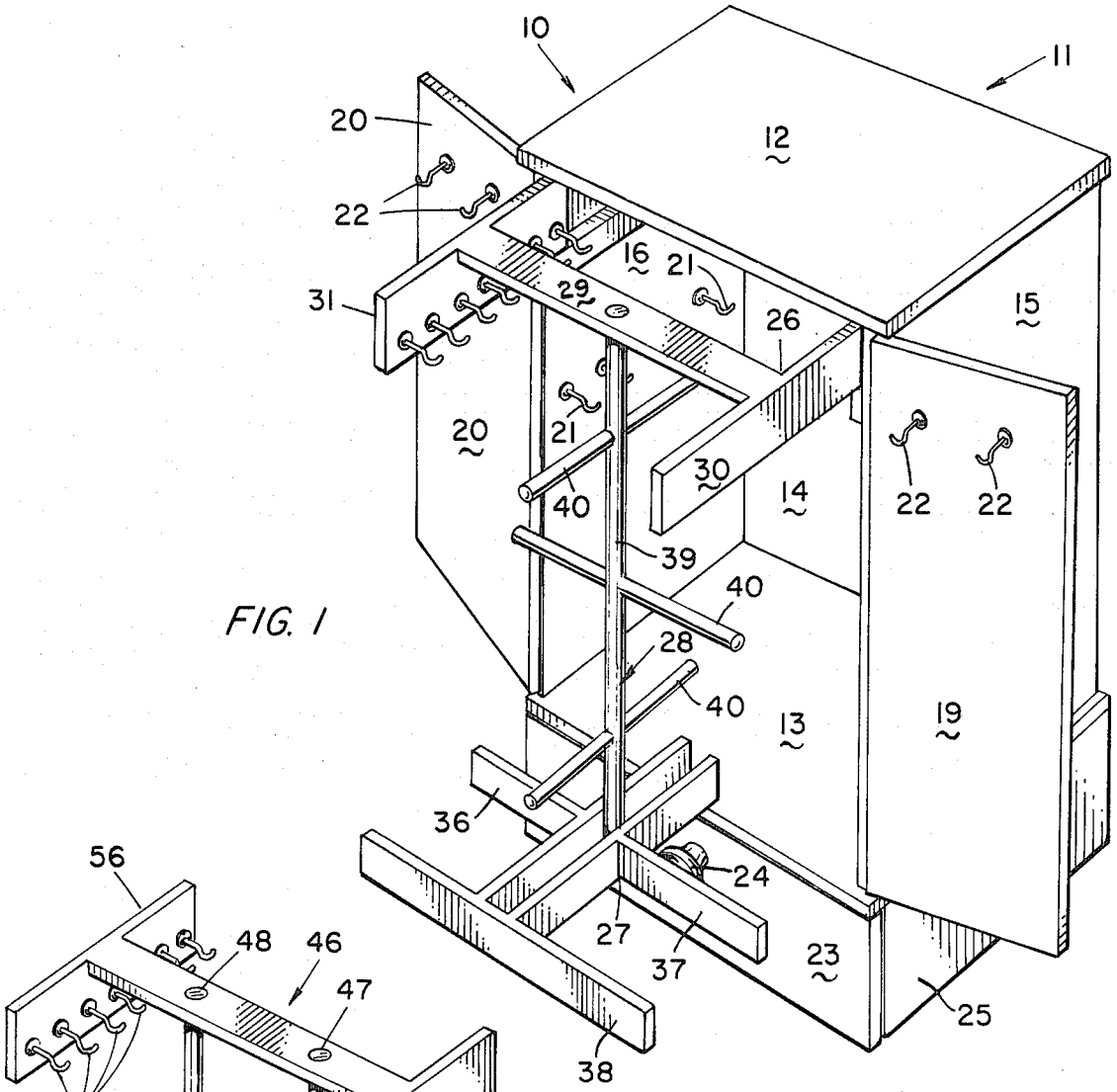
FIG. 1 is a perspective view of the present invention generally described as a jewelry box showing the doors open and the internal jewelry hanging frame disposed partially outside of the jewelry housing forming the jewelry box.
Figure 2:
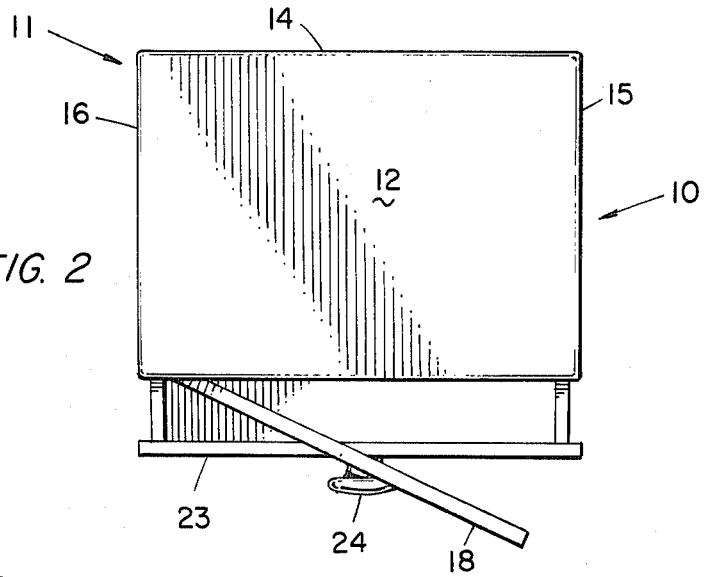
FIG. 2 is a plan view of the jewelry box with a single door opening thereinto with the single door shown partially opened and the underlying drawer also shown partially opened.

With continued reference now to all of the drawings herein, and with special emphasis now on FIG. 1, there is generally shown the new and improved jewelry box generally indicated at 10. Basically, the outside housing of the improved jewelry box 10 comprises a rectangular box, generally indicated at 11, having a top 12, a bottom forming a shelf 13, a rear vertical wall 14, as shown in FIG. 2, a pair of spaced-apart, oppositely facing sidewalls 15, 16 and a pair of hinged doors 19, 20. While a pair of hinged doors 19 and 20 is shown in FIG. 1, it should be clearly understood that rather the double doors 19 and 20 shown in FIG. 1, the invention can easily and conveniently be constructed using but a single door 18 as depicted in FIG. 2.

The rear vertical wall 14, and the pair of sidewalls 15, 16 are fixed relative to the bottom shelf 13 and the top 12 to form a solid, relatively rigid structure. This need for such a relatively rigid structure will become increasingly clearer as the description of the invention proceeds hereinafterwards.

A plurality of hooks 21 may be secured, if desired, to the inside of the rear wall 14, and the sidewalls 15 (not shown), 16. Also, hooks 22 for hanging jewelry items thereon may be secured to the inside of the doors 19, 20.

A drawer 23 may be installed beneath the bottom 13 of the rectangular box 11, if desired. Such a drawer 23 may be opened by manually pulling the knob 24 as shown in FIG. 2 of the drawings. FIG. 2 depicts the drawer 23 in a half-opened position. FIG. 1 shows the drawer 23 in its fully closed position.

In order to alignably and slidably capture the drawer 23 beneath the bottom shelf 13 of the rectangular box 11, an enclosure 25, having a pair of sidewalls (not shown), a rear wall (not shown) and a bottom (not shown), is provided to allow the drawer 23 to be operated by means of the knob 24. If desired, the rear wall (not shown) may be eliminated in order to allow the drawer 23 to be operated from either the front or the rear of the rectangular box 11.

A pair of oppositely-disposed frame members 26, 27 are employed to operably support a turnstile, generally shown at 28, as shown in FIG. 1. Frame member 26 forms the top support for the turnstile 28 and frame member 27 forms the bottom support.

Figure 6:
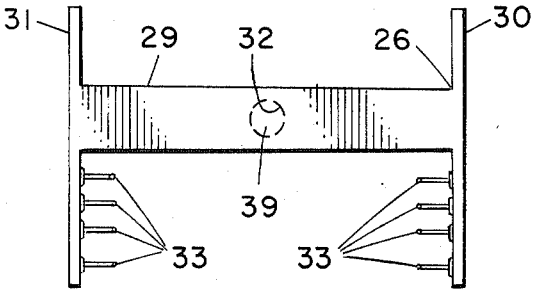
FIG. 6 is a plan view of the internal jewelry hanging frame shown disposed outside of the jewelry box.

As illustrated in FIG. 6, the top frame member 26 comprises a cross-member 29, with a pair of spaced-apart members 30, 31 being operably secured to the ends of the cross-member 29. A receptacle 32 is provided and disposed intermediately of the cross-member 29 to pivotally receive and hold the top of the turnstile 28. A plurality of hooks 33 are provided on the inside facing portions of the members 30, 31 whereby jewelry items, such as bracelets and necklaces may be hung therefrom. The total lateral dimension of the frame member 26 is slightly less than the inside width of the rectangle box 11 so that the frame member 26 can be easily slid thereinto.

Figure 3:
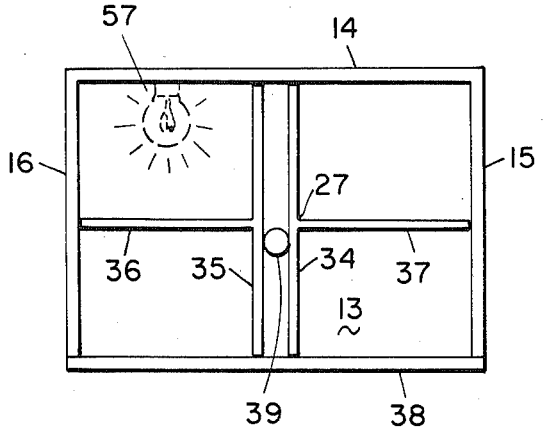
FIG. 3 is a horizontal cross sectional view of FIG. 1.

The bottom frame member 27 is depicted, in plan form, in FIG. 3, and is shown disposed within, or inside of, the rectangular box 11 disposed immediately above the bottom 13. A pair of guide rails 34, 35 are securely braced and disposed in spaced-apart, parallel face-to-face relationship by a pair of intermediately-disposed cross-members 36, 37 and a single front cross-member 38. The vertical pole portion 39 of the turnstile 28 is pivotally and slidably disposed between the guide rails 34, 35. Typically, the entire bottom frame member 27 is fixedly secured to the rectangular box 11. The front cross-member 38 acts to positionally orient the pair of guide rails 34, 35 within the rectangular box 11, along with the pair of cross-members 36, 37, all of which are vested between the sidewalls 15, 16 of the box 11. The guide rails 34, 35 act to maintain the pole 39 in operable pivotal alignment with respect to the top frame member 26.

Figure 5:
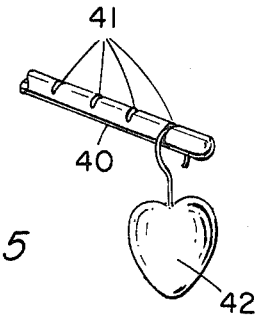
FIG. 5 is an enlarged view of a portion of one of the arms of the turnstile jewelry holders depicting one embodiment of how the arm is slotted to allow jewelry items, specifically pierced earrings, to be hung therefrom.
Figure 4:
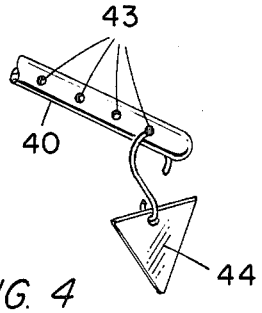
FIG. 4 is an enlarged view of a portion of one of the arms of the turnstile jewelry holders depicting one embodiment of how the arm is perforated to allow jewelry items, specifically pierced earrings, to be hung therefrom.

The turnstile generally indicated at 28 is composed of a vertical pole 39 and a plurality of arms 40 which are stagger mounted to the vertical pole 39 as shown in FIG. 1. A plurality of slotted portions 41 may be used in each of the arms 40 in order to segregate each jewelry item 42 hung thereon as depicted in FIG. 5. Alternatively, the slotted portions 41 of FIG. 5 may be apertures 43 by which to segregate various jewelry items 44 as shown in FIG. 4.

Figure 7:
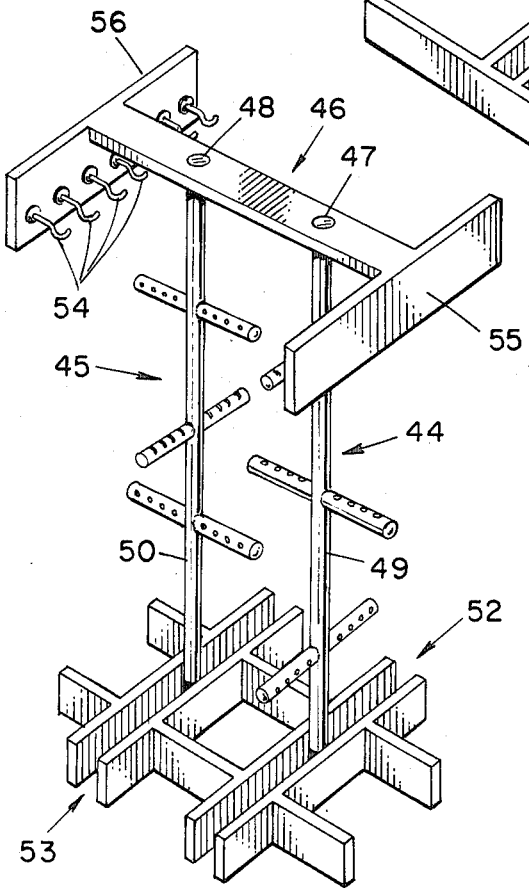
FIG. 7 is a perspective view of the jewelry hanging frame disposed outside of the jewelry box depicting an alternative dual turnstile arrangement for the frame.

An alternative embodiment, as shown in FIG. 7, depicts the use of a plurality of turnstiles generally indicated at 44 and 45. The turnstile support frame members, similar to that previously described and detailed herein, is shown in FIG. 7. The top frame member generally shown at 46 has a pair of receptacles 47 and 48 for pivotally receiving the vertical poles 49 and 50 of the pair of turnstiles 44 and 45. The bottom frame member generally indicated at 51 has a dual pair of guide rails 52 and 53 by which the vertical poles 49 and 50 are slidably and pivotally with the rectangular box 11.

A plurality of inside hooks 54 are mounted on the cross-members 55, 56 of the top frame member 46 to allow jewelry to be hung thereon. This arrangement does not depict a front cross-member similar to that shown in the single turnstile version of FIG. 1; however, it clearly may be incorporated therein to function in the same manner and fashion as described previously with respect to the front cross-member 38 of FIG. 1.

While the present invention has been described with respect to a particular preferred embodiment herein, it is clearly not intended for such to be limited or confined to the particular embodiment described and disclosed herein but is only to be limited by the scope and extent of the claims appended hereto.

For example, while this particular embodiment depicts a construction of wood, it may be equally desirable to construct same of partially or fully out of plastic materials, whether opaque or transparent. If transparent material is used, the entire box may be illuminated with a source of light, or alternatively, a light source 57, as shown in FIG. 3, may be incorporated therein to help one locate his of her particular jewelry items.

What is claimed is:

1. An improved jewelry storage and display box comprising:

(a) a rectangular box having a plurality of sides, a top and a bottom, at least three of said sides being fixedly disposed between said top and bottom, the remaining side being hingedly mounted to one of said fixed sides to provide ready access to the interior of said box;

(b) hook means disposed on the inside of said sides for segregating and hanging various types of jewelry thereon;

(c) a shelf fixed to at least three of said fixed sides, said shelf being disposed above the bottom of said box;

(d) drawer means operably disposed between said shelf, the bottom of said box and bounded by at least three of said fixed sides;

(e) guide and support means for said drawer means, said guide and support means being operably secured to at least two of said fixed sides;

(f) a rotatable turnstile the bottom of which is pivotally associated with the shelf, said turnstile having a plurality of arms extending therefrom for hanging various jewelry items therefrom;

(g) guide means for supporting the top and bottom of said rotatable turnstile, said guide means comprising a bottom frame member including a pair of oppositely disposed frame members spaced apart to operably support the bottom portion of the pole of the turnstile to allow the bottom end of the pole of the turnstile to be freely and slidably guided and supported therebetween, said pair of frame members being arranged so that the ends of said pair of frame members face the rear vertical wall and the hinged side, and a top frame member, said top frame member having a cross-member with a pair of spaced-apart members being operably secured to the ends of the cross-member and a receptacle disposed intermediately of the cross-member for pivotally supporting the top end of the pole of the turnstile therein, said top frame being slidably supported relative to said box; and (h) means disposed on said arms for segregating each such item of jewelry hung therefrom.

2. The improved jewelry storage and display box of claim 1 further comprising illumination means disposed therein for illuminating the jewelry items stored therein.

3. The improved jewelry storage and display box of claim 1 wherein said means disposed on said arms for segregating each such item of jewelry consists of a plurality of spaced-apart slots cut thereinto.

4. The improved jewelry storage and display box of claim 3 wherein the entrance to each of said slots faces upwardly towards the top of said box.

5. The improved jewelry storage and display box of claim 1 wherein said means disposed on said arms for segregating each such item of jewelry consists of a plurality of spaced-apart apertures in said arms.

6. The improved jewelry storage and display box of claim 1 where said rectangular box is formed of transparent material.

7. The improved jewelry storage and display box of claim 1 wherein said drawer means is formed of transparent material.

8. The improved jewelry storage and display box of claim 1 further comprising a second rotatable turnstile the bottom of which is pivotally associated with the shelf, said second turnstile having a plurality of arms extending therefrom for hanging various jewelry items therefrom.

* * * * *